United States Patent [19]

Asano

[11] 4,265,015

[45] May 5, 1981

[54] ADJUSTABLE RAZOR WITH BLADE CLEANING MEANS

[75] Inventor: Tamoru Asano, Seki, Japan

[73] Assignee: Kai Cutlery Center Company Limited, Gifu, Japan

[21] Appl. No.: 52,215

[22] Filed: Jun. 27, 1979

[30] Foreign Application Priority Data

Feb. 28, 1979 [JP] Japan ..... 54-23798

[51] Int. Cl.[3] ..... B26B 21/16

[52] U.S. Cl. ..... 30/41; 30/77; 30/47

[58] Field of Search ..... 30/41, 47, 61–63, 30/77, 78

[56] References Cited

U.S. PATENT DOCUMENTS

| | | | |
|---|---|---|---|
| 2,038,230 | 4/1936 | McWilliams | 30/61 |
| 2,069,920 | 2/1937 | Keighley | 30/61 |
| 3,263,328 | 8/1966 | Craig | 30/63 |
| 3,871,077 | 3/1975 | Nissen | 30/63 |
| 3,955,277 | 5/1976 | Pomfret | 30/47 |
| 4,037,321 | 7/1977 | Iten | 30/47 |

*Primary Examiner*—Gary L. Smith

*Attorney, Agent, or Firm*—Jordan and Hamburg

[57] ABSTRACT

A razor in which a razor blade and a blade support, on which the razor blade is mounted, move together back and forth with respect to the base of the razor so as to adjust the contacting angle with respect to the operator's skin. The base is provided on the top of the handle of the razor, and the razor blade and the blade support are covered by a top plate mounted on the base. Provided in front of the blade support is a guard member which projects forwardly beyond the cutting edge of the razor blade and extends parallel with the cutting edge. The blade support and the razor blade are moved back and forth by a rotatable operating member. When the blade support is retracted backwards, the whisker particles clinging to the blade are scraped off and dropped from between the base and the guard member.

10 Claims, 11 Drawing Figures

ADJUSTABLE RAZOR WITH BLADE CLEANING MEANS

FIELD OF THE INVENTION

This invention relates to a razor in which a razor blade and a blade support having a guard member can be integrally moved back and forth relative to the base of the razor so as to adjust the contacting angle of the razor with respect to the skin.

BACKGROUND OF THE INVENTION

The conventional razor is known to have the construction in which a guard located below and in front of the cutting edge is made to move independently of the razor blade so as to vary the shaving angle and the contacting angle.

Since in the conventional razor, the razor blade is adapted to move relative to the guard, the span (the distance between the guard and the cutting edge) and therefore the shaving angle (the angle between the horizontal level and the line connecting the guard top surface and the cutting edge) may vary while cutting whiskers. This is a disadvantage in that it will result in trembling of the cutting edge, especially when the span is long, subjecting the skin of the operator to pain.

Another disadvantage is that, because of the relative movement between the guard and the razor blade, they cannot always be kept parallel to each other and the cutting quality of the conventional razor is not stable.

OBJECTS OF THE INVENTION

Figure 1:
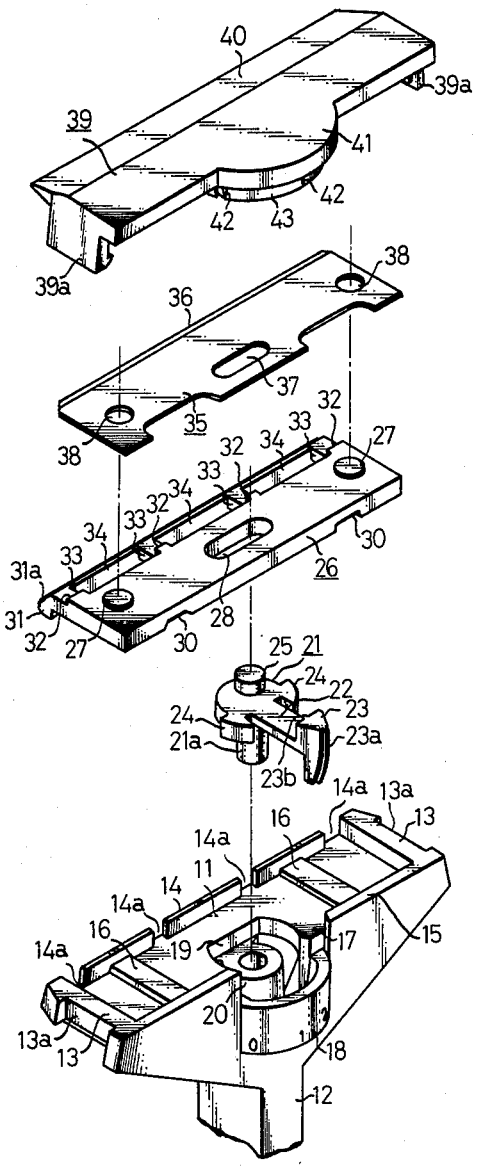
FIG. 1 is a perspective view of a razor in a disassembled state according to the present invention.

An object of this invention is to provide a razor, in which a distance between the cutting edge and the guard member is always constant even when the degree of projection of the cutting edge is adjusted, so that trembling of the blade can be prevented when in use.

Another object of this invention is to provide a razor which maintains a constant parallelism between the cutting edge and the guard member even when the degree of projection of the cutting edge is adjusted, so that the stable cutting quality of the razor is ensured.

Yet another object of this invention is to provide a razor in which the degree of projection of the cutting edge can easily be adjusted by an external operation, and in which the linear movement of the razor blade can be stably performed.

Still another object of this invention is to provide a razor in which the operating means for adjusting the projecting degree of the cutting edge is simple in construction and stable in operation.

A further object of this invention is to provide a razor in which the adjustment of the projecting degree of the cutting edge can be made either stepwise or non-stepwise.

Yet another object of this invention is to provide a razor in which whisker fragments that have been cut can easily be dropped through an exhaust hole.

Other objects and advantages of this invention will become apparent from the following description and claims.

DESCRIPTION OF THE PREFERRED EMBODIMENTS

One preferred embodiment will now be described with reference to the drawings.

Numeral 11 denotes the base of the razor molded integrally with and disposed on the top of a handle 12. Formed around the periphery of the upper surface of the base 11 are right- and left-hand side frames 13, a front frame 14 and a rear frame 15. An engagement groove 13*a* is cut on the outer side of each side frame 13, and guide grooves 14*a* are formed between the front frame 14 and the side frames 13, and also cut in the front frame 14 so that the front frame 14 is divided by the guide grooves 14*a* into three equal sections. A pair of guide rails 16 are provided on the upper surface of the base 11 on both sides between the front and rear frames 14, 15. One of the guide rails 16 has a rectangular cross section and the other has a trapezoidal cross section.

A recess 17 is formed by cutting out the central portion of the rear frame 15 and a semicircle indicator wall 18 is adapted to project rearwardly from the lower portion of the recess 17. On the outer surface of the indicator wall 18 there are marks 0, 1 and 2 on the left, the center and the right, respectively. Formed at the central portion of the top surface of the base 11 is a depressed portion 19 surrounded by the indicator wall 18. The depressed portion 19 contains at its center a support cylinder 20.

Designated by reference numeral 21 is an operating member whose downwardly projecting support shaft 21*a* is rotatably received in the support cylinder 20 disposed in the depressed portion 19. The operating member 21 has a vertically flexible operating lever 22 projecting rearwardly. Formed integral with and disposed at the end of the operating lever 22 is a knob 23, which has on its rear surface a longitudinally projecting indicator strip 23*a*, and on its frontal, upper portion a projection 23*b* that releaseably engages with a notch 42 of a top plate 39 to be described later. When the operating member 21 is rotated by its knob 23, the projected indicator strip 23*a* of the knob 23 is rotated along the outer surface of the indicator wall 18 to point at the mark 0, 1, or 2. The mark indicates the degree of projection of a cutting edge 36 from the base 11 and the top plate 39, as will be described later. An arcuate guide 24 is integrally formed on the operating member 21 on either side of the operating lever 22 so as to be guided by the cooperating arcuate surface of the depressed portion 19. Numeral 25 denotes an eccentric pin projecting from the upper surface of the operating member 21 and located at a position off-center from the support shaft 21*a*.

Reference numeral 26 designates a blade support which is movable to and fro relative to the upper surface of the base 11 on which it is mounted. On its upper surface the blade support 26 has projections 27 on both sides for fixing a razor blade 35, and at its central portion has a slot 28 for receiving the eccentric pin 25 of the operating member 21.

The front surface of the front frame 14 removes cut whiskers from the underside of the razor blade 35 as the blade is withdrawn backwards together with the blade support 26. The blade support 26 has two guide grooves 30 formed on its bottom on both sides and extending in the direction of the blade support width. These guide grooves 30 receive the guide rails 16 of the base 11 in a sliding relationship.

Denoted at 31 is a guard member provided integrally on and bridging across the end of arms 33, which project from the front end surface of the blade support 26 and are arranged equidistant from each other, with a step 32 formed between each arm 33 and the blade support 26. The guard member 31 has on its upper surface two or three projected strips 31*a* extending longitudinally. Small spaces formed by the front end surface of the blade support 26, the arms 33 and the guard member 31 constitute exhaust holes 34 through which cut whiskers are discharged. When the blade support 26 is mounted on the base 11, the arms 33 are received in the guide grooves 14*a* cut in the front frame 14 of the base 11 so that it can move back and forth through the guide grooves.

A razor blade 35 is secured on the upper surface of the blade support 26 and its front edge constitutes a cutting edge 36. The razor blade 35 has a slot 37 formed almost at its central portion corresponding to the slot 28 of the blade support 26, and also has fixing holes 38 formed on both sides corresponding to the projections 27 on the blade support 26. Accordingly, the razor blade 35 is set on the blade support 26 by inserting the projections 27 into the fixing holes 38. The portion of projection 27 projecting above the razor blade 35 may of course be melted, or the upper surface pressed to be expanded, so as to firmly secure the razor blade 35 to the blade support 26.

Indicated at 39 is a top plate fixed to the base 11 for holding the razor blade 35 therebetween in such a manner that the blade support 26 to which the razor blade 35 is secured can move back and forth. The top plate has on each side a downwardly projecting claw 39*a* which engages with the groove 13*a*, and the tip of the claw 39*a* hooks the bottom surface of the groove 13*a*. Formed on the front portion of the top plate 39 is a front edge 40 which becomes thinner towards its front end. The top plate 39 is provided at the central rear portion with a rearwardly projecting semicircular cover 41. Formed integrally with and slightly inside of the semicircular cover 41 is another semicircular wall 43 provided with notches 42 at locations corresponding to the figures 0, 1 and 2 on the indicator wall 18. Between the curved wall 43 of the top plate 39 and the upper surface of the indicator wall 18 of the base 11 there is a gap through which the operating lever 22 projects outwardly.

Figure 4:
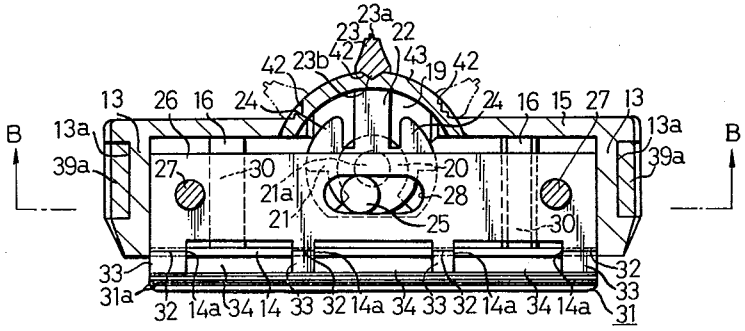
FIG. 4 is a horizontal sectional view taken along line A—A of FIG. 2.
Figure 3:
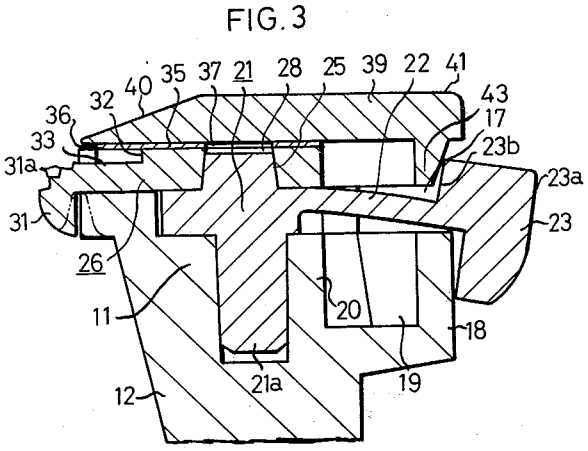
FIG. 3 is an enlarged sectional view of the razor showing the razor blade retracted backwards.
Figure 5:
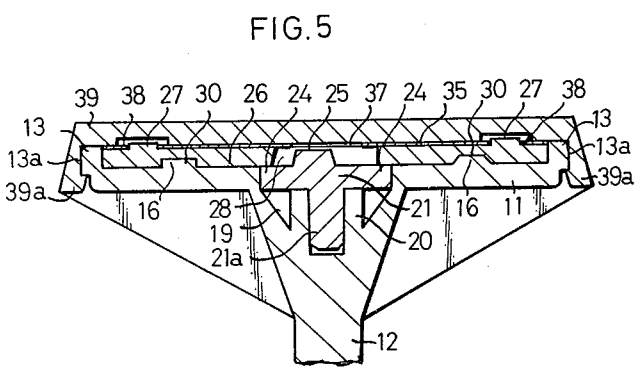
FIG. 5 is a vertical sectional view taken along line B—B of FIG. 4.

The operation of the razor with the construction described above will now be explained. This razor with a handle 12 may be used in a way similar to the ordinary razor. When the projected indicator strip 23*a* on the knob 23 of the operating member 21 is set to the mark "0" on the indicator wall 18, the eccentric pin 25 is positioned to the extreme left side of the slot 28 as shown in FIG. 4 and the blade support 26 assumes the rearmost position as shown in FIG. 3, causing the cutting edge 36 of the razor blade 35 to be withdrawn between the top plate 39 and the front frame 14 of the base 11.

In this condition where the razor 35 is completely retracted and no cutting edge 36 is exposed to the outside, the razor can be conveniently carried without danger.

Figure 2:
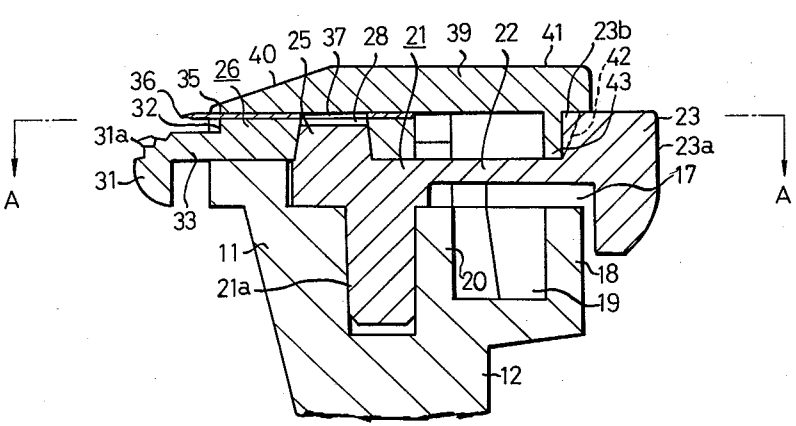
FIG. 2 is an enlarged sectional view of the razor showing a razor blade advanced forwards.

When the projected indicator strip 23*a* of the knob 23 is shifted to the mark "1" or "2", the eccentric pin 25 moves to the right as well as to the front causing the blade support 26 to advance forwardly. In this case, therefore, the razor blade 35 set at mark "2" projects more from the front edge of the top plate 39 than when set at the mark "1". When the projection 23*b* of the knob 23 engages with the notch 42 on the curved wall 43 of the top plate 39, the operating lever 22 is straight as shown in FIG. 2. When the projection 23*b* is out of engagement with the notch 42, the operating lever 22 is bent slightly downwardly against its flexibility, as shown in FIG. 3.

The blade support 26 moves back and forth with its one pair of guide grooves 30 sliding on a pair of guide rails 16 formed on the base 11. The guide rails 16 and the grooves 30 always maintain good sliding engagement with each other. In other wards, since one of the guide rails 16 is formed into a trapezoidal shape in section, if there should be a small difference between the rail-to-rail distance and the groove-to-groove distance, the lower edge of the groove 30, corresponding to the inclined surface of the guide rail of a trapezoidal cross section, contacts the inclined surface to thereby absorb the small difference, so that adequate engagement between the guide rails 16 and the grooves 30 is ensured.

In this way, the linear, stable movement of the blade support 26 is assured by the smooth engagement between the guide rails and the grooves.

Figure 6:
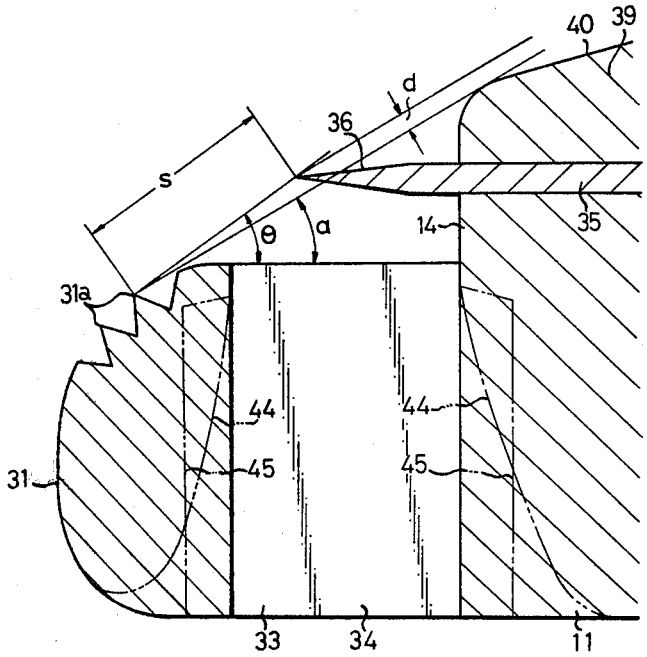
FIG. 6 is an enlarged sectional view showing the positional relation among a top plate, a guard member, a blade support and a razor blade of the razor shown in FIG. 1; and FIGS. *7a* through *7e* are plan views of flexible contacting portions provided on each side of the blade support.
Figure 7A:
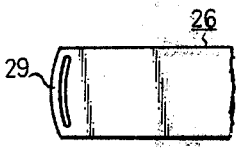
Figure 7C:
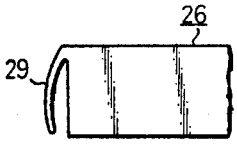
Figure 7E:
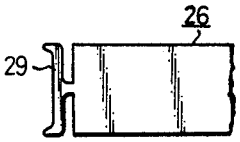
Figure 7B:
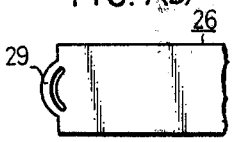
Figure 7D:
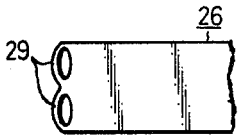

As can be seen in the foregoing, since the blade support 26 firmly supporting the razor blade 35 is adapted to be movable back and forth by the external operation, and since the blade support 26 and the guard member 31 are integrally formed, there is no relative movement between the cutting edge 36 and the guard member 31 so that they are always kept parallel to each other. Thus, the cutting quality of the razor will be constant along the cutting edge. Further, as shown in FIG. 6, the span (S) and the shaving angle ($\theta$) will also be kept constant. Therefore the skin of the operator will not feel pain as might be caused by trembling of the cutting blade of the conventional razor.

The blade support 26 may be moved forwards or backwards to vary the contact angle ($\alpha$) and adjust the degree of projection (d) of the cutting edge 36 depending upon beard thickness.

In the above embodiment, when the razor blade 35 is retracted together with the blade support 26, the whisker particles clinging to the underside of the cutting edge 36 are scraped off by the upper front edge of the front frame 14 of the base 11 and accumulate around the front frame 14. Since, when the blade support 26 is completely withdrawn, the rear surface or the inner surface of the guard member 31 approaches very closely the front frame 14 of the base 11, it is desirable to form cuts or notches 44 and 45 on the inner surface of the guard member 31 and also on the front surface of the front frame 14, as indicated by dotted lines in FIG. 6, so as to ensure smooth dropping of the whisker particles.

This invention can also be embodied in the following constructions.

(A) The blade support 26 may be provided on each side with a flexible contacting portion 29 which engages with the inner surface of the side frame 13 of the base 11, as shown in FIGS. *7a* through *7e*.

(B) The blade support 26 may have two razor blades with a spacer disposed therebetween such that the upper razor is disposed backwards relative to the lower razor.

(C) A handle 12 may be made detachable from the razor body.

(D) The degree of projection of the cutting edge 36 may be made adjustable non-stepwise. In the foregoing embodiment, it is possible to set the operating member 21 at locations other than the notches 42. This enables free adjustment of the projection degree of the cutting edge 36.

While we have so far explained in some detail the preferred embodiment of this invention, it is apparent that a wide range of modifications may be made to the above embodiment without departing from the spirit and the scope of this invention. It should be noted that this invention is not limited by any specific description on the foregoing embodiments except by the appended claims.

What is claimed is:

1. A razor comprising:

a base provided at the tip of a handle;

a top plate mounted on said base through attaching means;

a blade support disposed between the top plate and the base and adapted to receive a razor blade on its upper surface;

operating means for moving said blade support back and forth between the base and the top plate by being operated from outside the razor base, said operating means comprising an operating member rotatably supported by its own support shaft at the central rear portion of the base and a slot formed at the center of the blade support, said operating member comprising a support shaft, an operating lever extending rearwardly from the support shaft, a knob provided at the rear end of the lever and projecting rearwardly from between the base and the top plate, and an eccentric pin provided on the top of the support shaft, said slot extending perpendicular to the direction in which the blade support is moved;

and a guard member provided in front of the blade support and projecting forwardly beyond the cutting edge of the razor blade mounted on the blade support, said guard member extending parallel with the cutting edge.

2. A razor as set forth in claim 1, wherein said knob of the operating member has a projection that slides on a curved wall formed on the rear side of the top plate and which selectively registers with one of the notches formed on the curved wall.

3. A razor as set forth in claim 1, wherein said support shaft of the operating member has a guide portion for stabilizing the rotary movement of the operating member, said guide portion being disposed within a depressed portion for sliding movement along the inner wall of the depressed portion formed in the base.

4. A razor as set forth in claim 1, wherein said guard member is provided in front of the blade support and connected thereto through a plurality of arms so that at least one exhaust hole to drop whisker particles is formed by the inner surface of the guard member, the front surface of the blade support and the arms.

5. A razor as set forth in claim 4, wherein at least one of the inner surface of the guard member and the front surface of the base has a notch for facilitating the dropping of whisker particles.

6. A razor as set forth in claim 4, wherein said base has a front frame on its front portion which passes through the exhaust hole to bear against the underside of the razor blade so that when the blade support moves backwards the whisker particles clinging to the razor blade can be scraped off by the front frame and be dropped through the exhaust hole.

7. A razor as set forth in claim 1, wherein said attaching means for fixing the top plate to the base comprises a pair of grooves formed on the base on both sides and a pair of claws projecting downwardly from both ends of the top plate for engagement with said grooves.

8. A razor as set forth in claim 1, wherein said blade support and said base have a pair of grooves and a pair of guide rails respectively on their opposing surfaces, said guide rails and grooves extending along the direction of the movement of the blade support and being adapted for sliding engagement with each other.

9. A razor as set forth in claim 8, wherein one of said pair of guide rails has a rectangular cross section and the other a trapezoidal cross section.

10. A razor as set forth in claim 1, wherein said base has a pair of side frames on both sides and said blade support has a pair of elastic contacting portions which slidably bear against the inner surfaces of the side frames.

* * * * *